United States Patent [19]

Childs et al.

[11] Patent Number: 4,505,878

[45] Date of Patent: Mar. 19, 1985

[54] PROCESS FOR EXTRUSION OF COPPER

[75] Inventors: John B. Childs, London; Norman R. Fairey, Carshalton, both of England

[73] Assignee: BICC Public Limited Company, London, England

[21] Appl. No.: 400,479

[22] Filed: Jul. 21, 1982

[30] Foreign Application Priority Data

Aug. 6, 1981 [GB] United Kingdom ..... 8124113

[51] Int. Cl.[3] ..... B22F 3/02; B22F 7/04; B21C 23/01

[52] U.S. Cl. ..... 419/67; 428/553; 72/262; 72/270

[58] Field of Search ..... 419/41, 67; 428/553; 72/60, 80, 262, 270

[56] References Cited

U.S. PATENT DOCUMENTS

| | | | |
|---|---|---|---|
| 3,911,705 | 10/1975 | Voorhes | 72/45 |
| 4,055,979 | 11/1977 | Hunter et al. | 72/262 |
| 4,101,253 | 7/1978 | Etherington | 72/270 X |
| 4,362,485 | 12/1982 | Slater et al. | 72/60 X |
| 4,397,622 | 8/1983 | Childs et al. | 72/262 X |

FOREIGN PATENT DOCUMENTS 2069389A 8/1981 United Kingdom .

OTHER PUBLICATIONS

Pardoe–Recent Developments in "Conform"–Continuous Extrusion Technology, *Research Disclosure,* Mar. 1981, No. 203, Item No. 20342, (Havant, Hampshire, England).

*Primary Examiner*—Joseph L. Schofer
*Assistant Examiner*—F. Teskin
*Attorney, Agent, or Firm*—Buell, Ziesenheim, Beck & Alstadt

[57] ABSTRACT

In a continuous friction-actuated process for the extrusion of copper, a passageway 3 is formed between an arcuate first member and a second member in the form of a wheel 1 having a circumferential groove 2 formed in its peripheral surface into which groove the first member projects. The wheel is rotated and metal is fed into the passageway at one end and extrudes from the passageway through at least one die orifice 6 located in or adjacent to an abutment member 5 extending across the passageway at the other end thereof. The abutment member is of substantially smaller cross-section than the passageway so as to leave a substantial gap between the abutment member and the groove. Particulate copper is first fed under such conditions that at least a substantial proportion of the copper extrudes through the clearance y between the abutment and the groove surface and adheres to the wheel until the copper so extruded forms a complete lining 8 in the groove, and thereafter copper rod is fed for the remainder of the extrusion operation.

1 Claim, 6 Drawing Figures

PROCESS FOR EXTRUSION OF COPPER

This invention relates to the continuous friction-actuated extrusion of copper rod feed stock.

In our prior published British patent application No. 2069389A we have described and claimed a continuous friction-actuated extrusion process comprising forming a passageway extending from an entry end to an exit end between an arcuate first member and a second member in the form of a wheel having a circumferential groove formed in its peripheral surface into which groove the first member projects while rotating the wheel in such a direction that those surfaces of the passageway constituted by the groove travel from the entry end towards the exit end, feeding metal into the passageway at the entry end and extruding it from the passageway through at least one die orifice located in or adjacent to an abutment member extending across the passageway at the exit end thereof characterised by the facts that the abutment member (instead of being large enough to block the end of the passageway) is of substantially smaller cross-section than the passageway and leaves a substantial gap between the abutment member and the groove surface and that the metal is allowed to adhere to the groove surface, whereby a substantial proportion of the metal (as distinct from the inevitable leakage of flash through a working clearance) extrudes through the clearance and that this metal remains as a lining in the groove to re-enter the passageway at the entry end while the remainder of the metal extrudes through the die orifice(s).

We have used the process successfully to extrude a particulate feed of copper. Others have attempted to extrude copper rod feed using the conventional "Conform" friction-actuated extrusion process, and have found that an interference fit is necessary to reduce the slip-stick effect resulting from inefficient frictional grip between the groove surfaces and the rod. Further, continuously cast and rolled rod did not possess sufficient dimensional consistency unless it was first drawn through a die to circularise it, without substantial reduction in area.

In accordance with the present invention a continuous friction-actuated process for the extrusion of copper comprising forming a passageway extending from an entry end to an exit end between an arcuate first member and a second member in the form of a wheel having a circumferential groove formed in its peripheral surface into which groove the first member projects while rotating the wheel in such a direction that those surfaces of the passageway constituted by the groove travel from the entry end towards the exit end, feeding copper into the passageway at the entry end and extruding it from the passageway through at least one die orifice located in or adjacent to an abutment member extending across the passageway at the exit end thereof, the abutment member being of substantially smaller cross-section than the passageway so as to leave a substantial gap between the abutment member and the groove is characterised by first feeding only particulate copper into the passageway under such conditions that at least a substantial proportion of the said copper extrudes through the clearance between the abutment and the groove surface and adheres to the rotating wheel until the copper so extruded forms a complete lining in the groove, and thereafter feeding only copper rod to the passageway while continuing to rotate the wheel, so that copper continuously extrudes through the said clearance as a lining in the groove which re-enters the passageway at the entry end while further metal extrudes through the die orifice(s).

Normally some part of the particulate copper will pass outwardly through the die orifice(s) during the first stage of the process, and this may form part of the extrudate, or it may be scrapped. If desired however, the die orifice could be closed by a suitable blocking member of adequate strength until the lining of the groove is complete and feeding of rod commences.

Since particulate material needs to be fed for only a few turns of the wheel, and that only when the wheel is stripped clean and re-started, elaborate arrangements for feeding particulate material are not needed. Subject to accessibility of the feed opening, a simple hopper or funnel can be used, and the material fed by hand at an appropriate rate (preferably in accordance with our co-pending British (Published) patent application No. 2097301A).

By starting with particulate feed in this way a soundly bonded copper coating in the groove is readily formed and thereafter gives adequate adhesion for the copper subsequently fed in rod form.

The invention will be further described, by way of example, with reference to the accompanying drawings in which.

Figure 1:
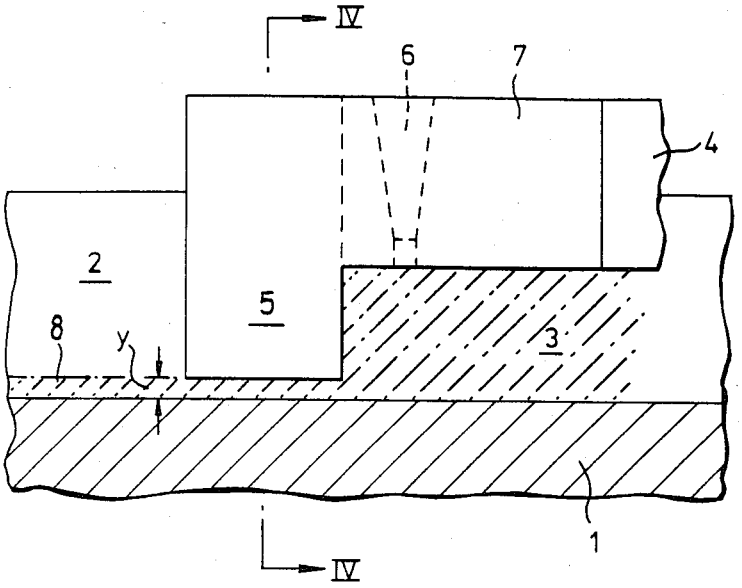
FIG. 1 is a fragmentary view of an extrusion machine (in accordance with our British [published] patent application 2069389A); suitable for carrying out the process of the invention.
Figure 2:
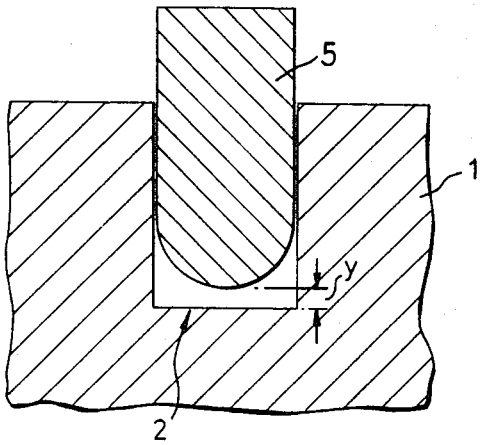
FIG. 2 is a cross-section on the line IV—IV in FIG. 1.

In the friction-actuated extrusion machine shown in FIGS. 1 and 2 a wheel 1, with a circumference of 1 meter, is formed with a rectangular groove 2, 12.5 mm in width, that forms three sides of the extrusion passageway 3. The fourth side is formed by an assembly comprising a shoe 4 (a small portion of which is shown), and a semicircular abutment 5, the cross-section of which is shown in FIG. 2.

A radial extrusion orifice 6 is formed in a die member 7 (which is preferably a separate component, though it might be integral with either the abutment or the shoe). Alternatively the die orifice may be formed tangentially through the abutment itself.

The shoe, abutment and die member are of high-strength materials and are held in position by heavy-duty support members (not shown), and cooling means will be provided.

The clearance y, between the abutment member 5 and the wheel 1, is not normally less than 1 mm at the closest point, through which a substantial portion of metal extrudes to form a layer 8 which adheres to the wheel and continues around it to re-enter the working passageway 3 in due course.

Figure 3:
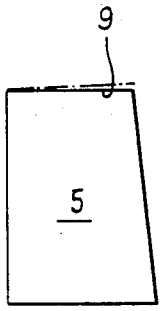
FIGS. 3 and 4 are mutually perpendicular views of the abutment forming part of the apparatus shown in FIGS. 1 and 2.
Figure 4:
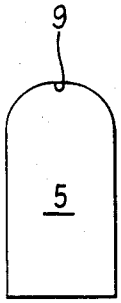

As best seen in FIG. 3, the curved surface 9 of the abutment is tapered in a longitudinal direction to minimise its area of contact with the metal being worked, consistent with adequate strength. A taper angle of 2° to 4° is considered suitable.

Figure 5:
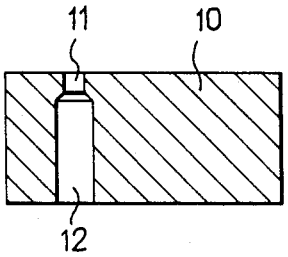
FIGS. 5 and 6 are mutually perpendicular views of a die member forming part of the apparatus shown in FIGS. 1 and 2.
Figure 6:
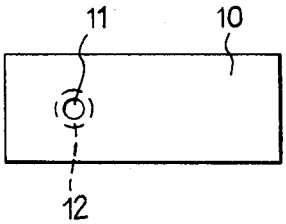

As shown in FIGS. 5 and 6, the preferred form of die member is a simple block 10 providing a die orifice 11 (which may be formed in an annular die insert), relieved by a counterbore 12 on the other side to provide a clearance around the extruded product.

Example

The machine was fed by hand with particulate copper with an average particle size of 2 to 3 mm, at ambient temperature, the wheel 1 revolving at 10 rpm, until the copper emerging through the clearance y between the abutment 5 and the wheel formed a layer 8 completely encircling the wheel.

Two lengths of 10 mm diameter rolled nominally—round copper feed rod were used successively; one was fed to the machine as such and the other was preshaped by cold rolling to a "D" section with a nominally flat side and a nominally semicircular side, the section being 10.6 mm high and 7.6 mm wide (from flat side to curved side). Each rod was introduced by hand, without the use of a coining roller, into the working passageway 3, to produce, in both cases, a 3.6 mm diameter wire of circular cross-section; the shaped rod was fed with its flat side adjacent the shoe so that its shape approximated the shape of the lined passageway.

| Feed Rod | Feed Rod Speed Entering Groove (meters per minute) | Extrusion Ratio |
|---|---|---|
| round | 1 | 7.7:1 |
| "D" shaped | 1.3 | 6.1:1 |

During the operation there is no tendency for the copper adhered to the wheel to be dislodged.

If either of the feed rods was inserted in the passageway without initially feeding particulate copper to the wheel, the grip achieved was so slight that no extrusion resulted. As is known (Modern Extrusion Symposium, Paper 2, University of Aston, June 4th, 1980) it was found necessary to preform the rolled rod to give a 0.15–0.30 mm interference fit in the groove, and to use a coining roller in order to achieve sufficient grip.

We claim:

1. A continuous friction-actuated process for the extrusion of copper comprising forming a passageway extending from an entry end to an exit end between an arcuate first member and a second member in the form of a wheel having a circumferential groove formed in its peripheral surface into which groove the first member projects while rotating the wheel in such a direction that those surfaces of the passageway constituted by the groove travel from the entry end towards the exit end, feeding metal into the passageway at the entry end and extruding it from the passageway through at least one die orifice located in or adjacent to an abutment member extending across the passageway at the exit end thereof, the abutment member being of substantially smaller cross-section than the passageway so as to leave a substantial gap between the abutment member and the groove is characterised by first feeding only particulate copper into the passageway and rotating the wheel under such conditions that at least a substantial proportion of the said copper extrudes through the clearance between the abutment and the groove surface and adheres to the wheel until the copper so extruded forms a complete lining in the groove, and thereafter feeding only copper rod to the passageway while continuing to rotate the wheel, so that copper continuously extrudes through the said clearance as a lining in the groove which re-enters the passageway at the entry end while further metal extrudes through the die orifice(s).

* * * * *